US010717952B2

(12) United States Patent
Eskuchen et al.

(10) Patent No.: US 10,717,952 B2
(45) Date of Patent: Jul. 21, 2020

(54) GRANULATES, METHOD FOR THE PRODUCTION AND USE THEREOF

(71) Applicant: BASF SE, Ludwigshafen am Rhein (DE)

(72) Inventors: Rainer Eskuchen, Langenfeld (DE); Robert Schuetz, Toenisvorst (DE)

(73) Assignee: BASF SE, Ludwigshafen am Rhein (DE)

( * ) Notice: Subject to any disclaimer, the term of this patent is extended or adjusted under 35 U.S.C. 154(b) by 98 days.

(21) Appl. No.: 15/770,532

(22) PCT Filed: Oct. 18, 2016

(86) PCT No.: PCT/EP2016/074920
§ 371 (c)(1),
(2) Date: Apr. 24, 2018

(87) PCT Pub. No.: WO2017/071984
PCT Pub. Date: May 4, 2017

(65) Prior Publication Data

US 2019/0055501 A1 Feb. 21, 2019

(30) Foreign Application Priority Data

Oct. 26, 2015 (EP) ..... 15191376

(51) Int. Cl.

| | |
|---|---|
| ***C11D 1/72*** | (2006.01) |
| ***C11D 1/825*** | (2006.01) |
| ***C11D 3/08*** | (2006.01) |
| ***C11D 3/10*** | (2006.01) |
| ***C11D 3/26*** | (2006.01) |
| ***C11D 11/00*** | (2006.01) |
| ***C11D 1/722*** | (2006.01) |
| ***C11D 3/12*** | (2006.01) |
| ***C11D 3/33*** | (2006.01) |
| ***C11D 17/06*** | (2006.01) |
| ***C11D 3/20*** | (2006.01) |
| ***C11D 3/37*** | (2006.01) |

(52) U.S. Cl.

CPC ..... *C11D 11/0023* (2013.01); *C11D 1/72* (2013.01); *C11D 1/721* (2013.01); *C11D 1/722* (2013.01); *C11D 1/825* (2013.01); *C11D 3/08* (2013.01); *C11D 3/10* (2013.01); *C11D 3/124* (2013.01); *C11D 3/126* (2013.01); *C11D 3/1246* (2013.01); *C11D 3/1273* (2013.01); *C11D 3/2086* (2013.01); *C11D 3/33* (2013.01); *C11D 3/3707* (2013.01); *C11D 11/0082* (2013.01); *C11D 17/06* (2013.01)

(58) Field of Classification Search

CPC .. C11D 1/72; C11D 1/825; C11D 3/08; C11D 3/10; C11D 3/124; C11D 3/1246; C11D 3/26; C11D 11/0082

See application file for complete search history.

(56) References Cited

U.S. PATENT DOCUMENTS

| | | | | |
|---|---|---|---|---|
| 2003/0114348 | A1 | 6/2003 | Kischkel et al. | |
| 2003/0144172 | A1 | 7/2003 | Weuthen et al. | |
| 2004/0186038 | A1 | 9/2004 | Kischkel et al. | |
| 2006/0079432 | A1 | 4/2006 | Weuthen et al. | |
| 2010/0294309 | A1 | 11/2010 | Tropsch | |
| 2014/0228271 | A1* | 8/2014 | Eiting | C11D 1/83 510/229 |
| 2015/0329802 | A1 | 11/2015 | Eiting et al. | |

FOREIGN PATENT DOCUMENTS

| | | | |
|---|---|---|---|
| DE | 102007019458 | A1 | 10/2008 |
| DE | 102011084934 | A1 | 4/2013 |
| EP | 1306422 | A1 | 5/2003 |
| WO | WO 01/48131 | A2 | 7/2001 |

OTHER PUBLICATIONS

Extended Search Report dated May 12, 2016 in European Patent Application No. 15191376.1 (with English Translation of categories of cited documents).

International Search Report dated Jan. 13, 2017, in PCT/EP2016/074920, filed Oct. 18, 2016.

* cited by examiner

*Primary Examiner* — Brian P Mruk

(74) *Attorney, Agent, or Firm* — Oblon, McClelland, Maier & Neustadt, L.L.P.

(57) ABSTRACT

A process for producing a formulation that is solid at up to a temperature of at least 60° C., wherein (a) at least one nonionic surfactant of the general formula (I), $R^1$—CH(OH)—$CH_2$-$(AO)_x$—$R^2$ (I) (wherein: $R^1$ is $C_4$-$C_{20}$-alkyl, $R^2$ is $C_8$-$C_{20}$-alkyl, AO are each independently $C_2$-$C_4$-alkylene, and x is in a range from 5 to 100), is mixed in a molten state with (b) at least one second substance selected from polyethylene glycol and nonionic surfactants different from surfactants of general formula (I), confectioned, mixed and ground in the solid state with (c) silica or silicate and (d) at least one auxiliary selected from alkali metal citrate, alkali metal carbonate or at least one chelating agent selected from compounds of the general formula (II), $R^3$—CH($COOM^1$)-N($CH_2COOM^1$)$_2$ (II) (wherein: $R^3$ is $C_1$-$C_4$-alkyl, phenyl, benzyl, $CH_2OH$ and $CH_2CH_2COOM^1$, and $M^1$ is an alkali metal or a combination of at least two alkali metals). Furthermore granules and their use.

9 Claims, No Drawings

GRANULATES, METHOD FOR THE PRODUCTION AND USE THEREOF

The present invention relates to a process for producing a formulation that is solid at up to a temperature of at least 60° C., wherein (a) at least one nonionic surfactant of the general formula (I)

$$R^1—CH(OH)—CH_2\text{-}(AO)_x—R^2 \quad (I)$$

in which the variables are defined as follows:

$R^1$ is selected from $C_4$-$C_{20}$-alkyl, $R^2$ is selected from $C_8$-$C_{20}$-alkyl, AO are in each case identical or different and selected from $C_2$-$C_4$-alkylene, x is in the range from 5 to 100, is mixed in the molten state (b) with at least one second substance selected from polyethylene glycol and nonionic surfactants which are different from surfactants of the formula (I), confectioned, mixed and ground in a mill in the solid state with (c) silica or silicate and (d) at least one auxiliary selected from alkali metal citrate, alkali metal carbonate or at least one chelating agent selected from compounds of the general formula (II)

$$R^3—CH(COOM^1)\text{-}N(CH_2COOM^1)_2 \quad (II)$$

in which the variables are defined as follows:

$R^3$ is selected from $C_1$-$C_4$-alkyl, phenyl, benzyl, $CH_2OH$ and $CH_2CH_2COOM^1$, $M^1$ is an alkali metal or a combination of at least two alkali metals.

Furthermore, the present invention relates to granules and their use.

Surfactants have numerous applications, for example in the sector of detergents and cleaners. Certain nonionic surfactants have gained importance as so-called rinse aid surfactants, for example for dishwasher detergents, for short also often referred to as ADW for "automatic dishwashing". Among these, mention is to be made in particular of numerous representatives of the so-called HMEs, where HME stands for hydroxy mixed ether. The formulation of hydroxy mixed ethers, however, is demanding, especially in solid formulations which serve as intermediates or end products.

Numerous hydroxy mixed ethers are substances with a wax-like appearance and a melting point of below 60° C., below 50° C. or even below 35° C. They are able to form supercooled melts which only exhibit a slight tendency towards crystallization even after a long time. Some hydroxy mixed ethers are hygroscopic exhibit and moreover—especially if the particle size is small—a tendency towards sticking. Although the storage stability can be improved by adding a so-called anticaking agent, in many cases these are incompatible with other ingredients of dishwasher formulations.

Solid formulations, for example powder granules which comprise hydroxy mixed ethers, can in some cases have a tendency towards sticking or caking. In the case of powders or granules that serve as intermediates, such sticking or caking can lead to further processing becoming difficult. In the case of powders or granules which serve as end products, are thus to be supplied to the consumer, such sticking or caking can lead to negative reactions.

It was therefore the object to provide a process by means of which solid formulations can be produced which comprise a hydroxymethyl mixed ether and which are easy to further process. It was also the object to be able to produce solid formulations which comprise a hydroxymethyl mixed ether and which are easy to further process.

Accordingly, the process defined at the start has been found which, in connection with the present invention, is also referred to as process according to the invention. The process according to the invention is a process for producing a formulation that is solid at up to a temperature of at least 60° C. In this connection, the melting point can be determined for example by dynamic differential calorimetry (DSC), advantageously at a heating rate of 10 K/min±1 K/min; initial weight 6-7 mg; flushing gas 3 l $N_2$/h, Al measurement crucible, open).

The process according to the invention comprises a plurality of steps. For this, the process according to the invention proceeds from at least one nonionic surfactant of the general formula (I), which in connection with the present invention can also be termed component (a), $$R^1—CH(OH)—CH_2\text{-}(AO)_x—R^2 \quad (I)$$

in which the variables are defined as follows:

$R^1$ is selected from $C_4$-$C_{20}$-alkyl, preferably n-$C_4$-$C_{20}$-alkyl. Examples are n-butyl, sec-butyl, isobutyl, n-pentyl, isopentyl, sec-pentyl, neopentyl, 1,2-dimethylpropyl, isoamyl, n-hexyl, isohexyl, sec-hexyl, n-heptyl, n-octyl, 2-ethylhexyl, n-nonyl, n-decyl, n-dodecyl, isododecyl, n-tetradecyl, isotetradecyl, stearyl, palmityl and n-eicosyl. Preferred examples are n-butyl, n-pentyl, isopentyl, n-hexyl, n-heptyl, n-octyl, n-nonyl, n-decyl, n-dodecyl, n-tetradecyl, stearyl, palmityl and n-eicosyl. Particularly preferred examples are n-octyl and n-decyl.

$R^2$ is selected from $C_8$-$C_2O$-alkyl, preferably n-$C_8$-$C_{20}$-alkyl, examples being n-octyl, 2-ethylhexyl, n-nonyl, n-decyl, n-undecyl, iso-$C_{11}H_{23}$, n-dodecyl, isododecyl, n-tetradecyl, isotetradecyl, stearyl, palmityl and n-eicosyl. Preferred examples are n-octyl, n-nonyl, n-decyl, n-undecyl, iso-$C_{11}H_{23}$, n-dodecyl, isododecyl, n-tetradecyl, stearyl, palmityl and n-eicosyl. Particularly preferred examples are iso-$C_{11}H_{23}$.

AO are in each case identical or different and selected from $C_2$-$C_4$-alkylene, for example $CH_2$—$CH_2$—O, $(CH_2)_3$—O, $(CH_2)_4$—O, $CH_2CH(CH_3)$—O, $CH(CH_3)$—$CH_2$—O— and $CH_2CH(n\text{-}C_3H_7)$—O. Particularly preferably, AO is in each case identical and $CH_2$—$CH_2$—O, for short also "EO".

x is in the range from 5 to 100, preferably 5 to 60, even more preferably 10 to 50 and particularly preferably 20 to 40.

In one embodiment of the present invention, $(AO)_x$ is selected from $(CH_2CH_2O)_{x1}$, where x1 is in the range from 1 to 50.

In one embodiment of the present invention, $(AO)_x$ is selected from —$(CH_2CH_2O)_{x2}$—$(CH_2CH(CH_3)$—$O)_{x3}$ and —$(CH_2CH_2O)_{x2}$—$(CH(CH_3)CH_2$—$O)_{x3}$, where x2 and x3 can be identical or different and are in each case in the range from 1 to 30.

In one embodiment of the present invention, $(AO)_x$ is selected from —$(CH_2CH_2O))_{04}$, where x4 is in the range from 10 to 50, AO is in each case EO, and $R^1$ and $R^2$ are in each case selected from $C_8$-$C_{14}$-alkyl.

In connection with the present invention, x or x1 or x2 or x3 or x4 are in each case to be understood as average values, with the number-average being preferred. Consequently, x or x1 or x2 or x3 or x4—if present—may be a fraction although individual molecules in each case have a whole number of AO units.

In a particularly preferred embodiment of the present invention, the variables are selected as follows: $R^1$ is n-$C_8$-$C_{10}$-alkyl, $R^2$ is $C_8$-$C_{12}$-alkyl, straight-chain or as iso-$C_8$-$C_{12}$-alkyl, x is in the range from 20 to 25.

In one embodiment of the present invention, component (a) has a melting point in the range from 30 to 60° C., preferably 35 to 55° C. The melting point of component (a) can be measured as specified above.

Component (a) is mixed with (b) at least one second substance, in the context of the present invention also termed component (b), and which is selected from polyethylene glycol and nonionic surfactants which are different from surfactants of the formula (I).

Examples of polyethylene glycol are polyaddition products of ethylene oxide with an average molecular weight $M_w$ in the range from 1000 to 50 000 g/mol, preferably 2000 to 20 000 g/mol.

Examples of nonionic surfactants which are different from component (a) are alcohol alkoxylates, di- and multiblock copolymers of ethylene oxide and propylene oxide and reaction products of sorbitan with ethylene oxide or propylene oxide, also alkyl glycosides.

Preferred examples of alkoxylated alcohols and alkoxylated fatty alcohols are, for example, compounds of the general formula (III)

(III)

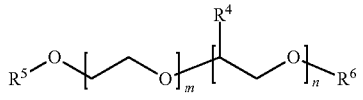

in which the variables are defined as follows:

$R^4$ is selected from linear $C_1$-$C_4$-alkyl, preferably ethyl and particularly preferably methyl, $R^5$ is selected from $C_8$-$C_{22}$-alkyl, for example n-$C_8H_{17}$, n-$C_{10}H_{21}$, n-$C_{12}H_{25}$, n-$C_{14}H_{29}$, n-$C_{16}H_{33}$ or n-$C_{18}H_{37}$, $R^6$ is selected from $C_1$-$C_{10}$-alkyl, methyl, ethyl, n-propyl, iso-propyl, n-butyl, isobutyl, sec-butyl, tert-butyl, n-pentyl, isopentyl, sec-pentyl, neopentyl, 1,2-dimethylpropyl, isoamyl, n-hexyl, isohexyl, sec-hexyl, n-heptyl, n-octyl, 2-ethylhexyl, n-nonyl, n-decyl or isodecyl, m and n are in the range from 0 to 300, where the sum of n and m is at least one. Preferably, m is in the range from 1 to 100 and n is in the range from 0 to 30.

Here, compounds of the general formula (I) can be block copolymers or random copolymers, preference being given to block copolymers.

Other preferred examples of alkoxylated alcohols and alkoxylated fatty alcohols are, for example, compounds of the general formula (IV)

(IV)

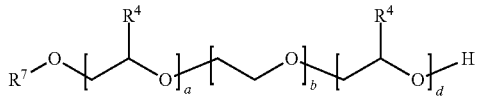

in which the variables are defined as follows:

$R^4$ is identical or different and selected from linear $C_1$-$C_4$-alkyl, preferably in each case identical and ethyl and particularly preferably methyl, $R^7$ is selected from $C_6$-$C_{20}$-alkyl, in particular n-$C_8H_{17}$, n-$C_{10}H_{21}$, n-$C_{12}H_{25}$, n-$C_{14}H_{29}$, n-$C_{16}H_{33}$, n-$C_{18}H_{37}$.

a is a number in the range from 1 to 6, b is a number in the range from 4 to 20, d is a number in the range from 4 to 25.

Here, compounds of the general formula (IV) can be block copolymers or random copolymers, preference being given to block copolymers.

Further suitable nonionic surfactants are selected from di- and multiblock copolymers composed of ethylene oxide and propylene oxide. Further suitable nonionic surfactants are selected from ethoxylated or propoxylated sorbitan esters and isosorbitol esters. Further suitable nonionic surfactants are selected from di-fatty acid esters of polyethylene glycol, for example polyethylene glycol diesterified with stearic acid and having an average molecular weight $M_w$ in the range from 1500 to 2500 g/mol.

Examples of alkyl polyglycosides are compounds of the general formula (VI)

(VI)

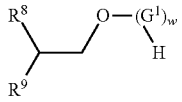

where the variables are defined as follows:

$R^8$ is hydrogen or $C_1$-$C_4$-alkyl, preferably ethyl, n-propyl and isopropyl, and hydrogen, $R^9$ is —$(CH_2)_2$—$R^8$, $G^1$ is selected from monosaccharides having 4 to 6 carbon atoms, in particular glucose and xylose, w is in the range from 1.1 to 4, where w is an average value, in particular the number-average. Preferably, w is in the range from 1.1 to 2 and particularly preferably in the range from 1.2 to 1.8. It is preferred to determine w by high-temperature gas chromatography (HTGC).

In one embodiment of the present invention, component (b) has a melting point in the range from 35 to 70° C., preferably 50 to 65° C. The melting point of component (b) can likewise be measured by dynamic DSC.

In a preferred embodiment of the present invention, the melting point of component (a) is below that of component (b).

To carry out the process according to the invention, firstly components (a) and (b) are mixed in the molten state. The mixing temperature is selected such that the lower melting component—i.e. component (b) or preferably component (a)—is present in the molten state. The higher-melting component in each case can be present in the solid or molten state. Preferably, component (a) and component (b) are mixed in the proportions intended for formulation in question.

In a particular embodiment of the present invention, component (a) is melted during mixing.

Component (a) and component (b) are mixed until a homogeneous mixture is perceived visually—with the naked eye, i.e. without visual aids.

Preferably, component (a) and component (b) are mixed at a temperature which is at least 5° C. above the melting point of component (a), particularly preferably at least 10° C.

In a particular embodiment of the present invention, component (a) and component (b) are mixed at a temperature which is at least 5° C. above the temperature at which the higher-melting component melts.

To effect the mixing operation, the procedure can involve initially introducing components (a) and (b) in solid form into a mixing vessel and heating with mixing—for example shaking or preferably with stirring—until the lower-melting component in each case has melted. Then, mixing is continued until a homogeneous mixture is perceived with the naked eye, i.e. neither separate particles nor streaking can be seen.

Examples of suitable mixing vessels are stirred vessels such as, for example, stirred reactors and stirred tanks.

In the following step, the mixture obtained in the first step of the process according to the invention is confectioned. In connection with the process according to the invention, this is to be understood as meaning that the mixture from the first step is processed in such a way that it is converted to solid particles with the desired dimensions. Preferred examples are pastillations, flakings, grindings and combinations of at least two of the preceding measures. If the mixture obtainable in the first step of the process according to the invention is to be ground, then it is left to solidify first.

Pastillation can be performed, for example, by pouring a mixture obtained in the first step of the process according to the invention into a mold with corresponding depressions and allowing the mixture to cool in the corresponding mold. Then, the cooled mixture—simply the pastilles—is removed from the mold and mixture is poured afresh into the mold. In another embodiment, cooling belts are selected for the pastillation. Pastilles can for example have a diameter in the range from 4 to 10 mm.

Flaking can be performed for example by using a flaking roller. The size of the flakes can depend on the product properties and the machine settings. As a rule, irregularly shaped flakes are obtained. Suitable average dimensions are, for example, lengths in the range from 1 mm to 2 cm, widths from 1 mm to 1.5 cm and thicknesses in the range from 0.5 mm to 3 mm.

Examples of particularly well suited devices for grinding are impact mills and cutting mills. While mixing in a mill, grinding is performed simultaneously.

This gives a confectioned mixture of component (a) and component (b) that is solid at room temperature.

In the next step of the process according to the invention, the confectioned mixture of component (a) and component (b) that is solid at room temperature is mixed in a mill in the solid state with (c) silica or silicate, in the context of the present invention also termed silica (c) or silicate (c) or more generally component (c), and (d) at least one auxiliary, for short also referred to as auxiliary (d) or component (d), where component (d) is selected from alkali metal citrate, for example trisodium citrate, alkali metal carbonates such as, for example, potassium carbonate or sodium carbonate, or at least one chelating agent, selected from compounds of the general formula (II)

$$R^3—CH(COOM^1)-N(CH_2COOM^1)_2 \quad (II)$$

in which the variables are defined as follows:

$R^3$ is selected from $C_1$-$C_4$-alkyl, for example methyl, ethyl, n-propyl, isopropyl, n-butyl, sec-butyl, isobutyl, preferably methyl, sec-butyl and isobutyl and very particularly preferably $R^3$ is methyl; furthermore phenyl, benzyl, $CH_2OH$ and $CH_2CH_2COOM^1$, $M^1$ is an alkali metal or a combination of at least two alkali metals, for example lithium, sodium, potassium, preferably potassium, sodium and combinations of potassium and sodium, for example in a quantitative ratio in the range from 1:2 to 2:1, and very particularly preferably $M^1$ is sodium.

Silica (c) can be selected from precipitated silicas and fumed silicas.

Examples of silicates (c) are sodium disilicate and sodium metasilicate, zeolites and sheet silicates, in particular those of the formula $\alpha$-$Na_2Si_2O_5$, $\beta$-$Na_2Si_2O_5$ and $\delta$-$Na_2Si_2O_5$.

In one embodiment of the present invention, either two different silica gels or two different silicates are used as auxiliary (c). Different silica gels or different silicates can differ in each case in particle size, surface acidity or crystal structure.

In another embodiment of the present invention, a silica and a silicate are used as auxiliary (c).

In another embodiment of the present invention, only one auxiliary (c) is used.

In one embodiment of the present invention, silica (c) has an average particle diameter (volume-average) in the range from 5 to 100 μm, preferably 5 μm to at most 20 μm, determined by laser diffraction according to ISO 13320-1 (2009).

In one embodiment of the present invention, silicate (c) has an average particle diameter (volume-average) in the range from 5 μm to at most 20 μm, determined by laser diffraction according to ISO 13320-1 (2009).

Grinding takes place during the mixing.

In one embodiment of the present invention, mills for the third step of the process according to the invention are selected from mills with a relatively small energy input. Preference is given to impact and cutting mills.

In one embodiment of the present invention, the fraction of component (b) is at least as high as the fraction of nonionic surfactant of the general formula (I).

In one embodiment of the present invention, the quantitative ratios for the process according to the invention are selected as follows:

(a) in the range from 15 to 25% by weight of nonionic surfactant of the general formula (I), (b) in total in the range from 5 to 40% by weight of component (b), (c) in total 1 to 5% by weight of silica or silicate, preferably 2 to 3% by weight, and (d) in total in the range from 40 to 70% by weight of component (d), preferably 42 to 60% by weight.

This gives free-flowing granules. Granules obtainable by the process according to the invention are easy to process, for example to give tablets ("tabs") for ADW and to give rinse aid tabs for ADW. Granules obtainable by the process according to the invention are not very hygroscopic and have a lower tendency towards sticking or caking.

A further aspect of the present invention relates to granules, for short also referred to as granules according to the invention. Granules according to the invention have an average particle diameter in the range from 0.5 to 1.6 mm and comprise (a) in the range from 15 to 25% by weight of nonionic surfactant of the general formula (I), $$R^1—CH(OH)—CH_2-(AO)_x—R^2 \quad (I)$$

in which the variables are defined as follows:

$R^1$ is selected from 04-$C_{20}$-alkyl, $R^2$ is selected from $C_8$-$C_{20}$-alkyl, AO are in each case identical or different and selected from $C_2$-$C_4$-alkylene, x is in the range from 5 to 100, (b) in total in the range from 5 to 25% by weight of second substance, selected from polyethylene glycol and nonionic surfactants which are different from surfactants of the formula (I), (c) in total 1 to 5% by weight of silica or silicate, and (d) in total in the range from 40 to 70% by weight of auxiliaries selected from alkali metal citrate, alkali metal carbonate or at least one chelating agent selected from compounds of the general formula (II)

$$R^3—CH(COOM^1)-N(CH_2COOM^1)_2 \quad (II)$$

in which the variables are defined as follows:

$R^3$ is selected from $C_1$-$C_4$-alkyl, phenyl, benzyl, $CH_2OH$ and $CH_2CH_2COOM^1$, $M^1$ is an alkali metal or a combination of at least two alkali metals, where granules according to the invention are solid at a temperature of up to 60° C.

Components (a), (b), (c) and (d) are described above in more detail.

In a preferred embodiment of the present invention, granules according to the invention have a particle diameter distribution as follows: $d_m$ is in the range from 0.5 to 1.8 mm, $d_{63.3}$ is in the range from 0.4 to 1.8 mm and n is in the range from 0.7 to 10, determined in each case with the help of sieve analysis according to DIN ISO 3310-1 (1992) and evaluation according to DIN 66145 (1976).

Granules according to the invention can be further processed to give dishwasher tabs and in particular rinse aid tabs, but also to give rinse aids for a dishwasher or as component for an x-in-1 dishwashing detergent, for example a 2-in-1 dishwashing detergent or a 3-in-1 dishwashing detergent. The present invention therefore further pro-vides the use of granules according to the invention as or for producing a rinse aid. In a preferred variant of the present invention, the rinse aid is a rinse aid for a dishwasher or a component for an x-in-1 dishwashing detergent, for example a 2-in-1 dishwashing detergent or a 3-in-1 dishwashing detergent.

In one embodiment of the present invention, granules according to the invention can be used without further additives as rinse aids in a dishwasher, in particular in x-in-1 dishwashing detergents. In another embodiment, at least one additive is also added, selected from water and acids, for example citric acid.

The invention is further illustrated by means of working examples.

Melting points were determined by dynamic differential calorimetry (DSC), heating rate of 10K/min±1K/min; initial weight 6-7 mg; flushing gas 3 l $N_2$/h, Al measuring crucible, open Components Used:

(a.1): n-$C_8H_{17}$—CH(OH)—$CH_2$-$(AO)_{22}$-iso-$C_{11}H_{23}$, melting point: 32° C.

(b.1): Polyethylene glycol, $M_w$ 4000 g/mol (c.1): Precipitated silica, average particle diameter d50: 13.5 μm (laser diffraction), surface area according to BET: 190 $m^2$/g, determined by nitrogen adsorption ISO 92777.

(c.1) is commercially available as Sipernat® 22 S (d.1): Trisodium salt of citric acid as dihydrate The solid formulation was produced in each case as follows:

The components (a.1) and (b.1) were melted together in a beaker at 70° C. and mixed using a propeller stirrer. Then, the melt was poured onto aluminum foil (20 cm×10 cm×1 cm) and solidified at room temperature. This gave wax-like plates.

Pastilles were produced from these wax-like plates using a flake roller. The flake roller used had a diameter of 33 cm, a width of 50 cm and was operated at a speed of 1.2 rpm. The coolant temperature (water) was 16 to 22° C. To produce the pastilles, the procedure in detail involved placing the wax-like plates into a heatable dropping funnel 38 cm in width which was provided on the bottom with 36 holes (diameter 1.5 mm). The melting rate of the plate was adjusted via the funnel temperature of 80 to 100° C. in such a way that defined drops were formed on the cooling surface of the roller, said drops solidifying within one revolution and then being stripped off from the roller by means of a non-flexible knife attached thereto.

The pastilles produced in this way were ground in an impact mill (knife mill). For this, the mill was operated with 2 knives and a peripheral speed of 14 m/s. The grinding sieve used was a round perforated sieve with a hole diameter of 3.2 mm and a free surface area of 40%. The pastilles, the component (d.1) and silica (c.1) were metered into this mill simultaneously and ground.

The following granules according to the invention and comparison granules were obtained, see table 1.

TABLE 1

Granules according to the invention and comparison granules

| | (G.1) | C-(G.2) | C-(G.3) | (G.4) |
|---|---|---|---|---|
| (a.1) | 24.25 | 29.1 | 33.95 | 24.25 |
| (b.1) | 24.25 | 19.4 | 33.95 | 24.25 |
| (c.1) | 48.5 | 48.5 | 29.1 | 48.5 |
| (d.1) | 3.0 | 3.0 | 3.0 | 3.0 |
| Grindability | ++ | – | – | ++ |
| Flowability | ++ | – | – | ++ |
| Storage test | ++ | | | ++ |

Fractions of (a.1), (b.1), (c.1) and (d.1) in % by weight.

The storage test related to a storage at 40° C. over a time of 72 hours with the exclusion of moisture. It was carried out as follows: 15 ml of granules or comparison granules were poured into a cylinder opened at the top and bottom. So that the granules did not run out of the cylinder, it stood with its bottom opening on a baseplate. The upper opening was provided with a punch and this was loaded with a weight of 500 g and the entire system was stored for 72 h at 40° C. It was then tested how the granules had changed as a result of the storage at a temperature of 40° C. and simultaneous weight loading. If these parameters were without influence, the granules flowed out of the bottom opening after lifting up the cylinder. If the granules had a tendency towards sticking, then a compact was formed, which was carefully pressed out of the cylinder using the punch. The compact was placed under the pan of a beam balance. On this pan stood a beaker which was filled with water until the compact broke. The measurement value thus obtained for the amount of water can be used to draw conclusions as to the storability of granules. Products which do not form a compact exhibit very good storage properties (granules according to the invention G.1 and G.4).

The particle diameter distribution of the example granules was determined as follows by means of sieve analysis:

Sieve machine: AS 200 control, Retsch, analysis sieve according to DIN ISO 3310-1, height 25 mm; Ø 200 mm Amplitude: 0.6, sieve time: 2 min The particle diameter distributions obtained by the sieve analysis were used to ascertain the parameters $d_m$, $d_{63.3}$ and n, with which the granulometry of the example granules is described.

Graphical evaluation of the particle diameter distribution by means of a Rosin, Rammler, Sperling and Bennet diagram (RRSB distribution) gives rise to $d_{63.3}$: characteristic particle size n uniformity coefficient (exponent n)

If the granulometric state of the heaped material cannot be described by a RRSB distribution, e.g. in the case of mixtures of heaped materials of differing granulometry, the aforementioned parameters are also valid for sections of the distribution which follow the RRSB distribution.

Example (G.1) d<0.4 mm: 22.6%
d≥1.6 mm: 0%
$d_m$=0.69 mm
$d_{63.3}$=0.8 mm
n=2.0
C-G.2 no measurable granules obtained
C-G.3 no measurable granules obtained
Example (G.4) d<0.4 mm: 29.8%
d≥1.6 mm: 10.6%
$d_m$=0.71 mm
$d_{63.3}$=0.79 mm
n=1.49

The invention claimed is:

1. A process for producing a formulation that is solid at up to a temperature of at least 60° C., the process comprising:

mixing in a molten state (a) at least one nonionic surfactant of the general formula (I)

$$R^1—CH(OH)—CH_2-(AO)_x—R^2 \quad (I)$$

in which the variables are defined as follows:

$R^1$ is selected from $C_4$-$C_{20}$-alkyl,
$R^2$ is selected from $C_8$-$C_{20}$-alkyl,
AO are in each case identical or different and selected from $C_2$-$C_4$-alkylene, and
x is in a range from 5 to 100, with (b) at least one second substance selected from polyethylene glycol and nonionic surfactants which are different from surfactants of the formula (I), confectioning the mixture; and mixing and grinding the mixture in a mill in a solid state with (c) silica or silicate and (d) at least one auxiliary selected from alkali metal citrate, alkali metal carbonate or at least one chelating agent selected from compounds of the general formula (II)

$$R^3—CH(COOM^1)-N(CH_2COOM^1)_2 \quad (II)$$

in which the variables are defined as follows:

$R^3$ is selected from $C_1$-$C_4$-alkyl, phenyl, benzyl, $CH_2OH$ and $CH_2CH_2COOM^1$, and
$M^1$ is an alkali metal or a combination of at least two alkali metals, wherein the components are present in the formulation in quantitative ratios as follows:

(a) in a range from 15 to 25% by weight of the at least one nonionic surfactant of the general formula (I), (b) in a total range from 5 to 40% by weight of the at least one second substance, (c) in a total range from 1 to 5% by weight of silica or silicate, and (d) in a total range from 40 to 70% by weight of the at least one auxiliary, and wherein a fraction of component (b) in the formulation is at least as high as a fraction of component (a).

2. The process according to claim 1, wherein the formulation is free from phosphates and polyphosphates.

3. The process according to claim 1, wherein the confectioning is selected from pastillations, flakings, grindings and combinations of at least two of the preceding measures.

4. The process according to claim 1, wherein the compound of the general formula (I) has a melting point in a range from 25 to 60° C.

5. The process according to claim 1, wherein either two different silicas or two different silicates are used as the auxiliary (c).

6. A granule with an average particle diameter in a range from 0.5 to 1.6 mm, comprising (a) 15 to 25% by weight of a nonionic surfactant of the general formula (I), $$R^1—CH(OH)—CH_2-(AO)_x—R^2 \quad (I)$$

in which the variables are defined as follows:

$R^1$ is selected from $C_4$-$C_{20}$-alkyl,
$R^2$ is selected from $C_8$-$C_{20}$-alkyl,
AO are in each case identical or different and selected from $C_2$-$C_4$-alkylene, and
x is in the range from 5 to 100, (b) 5 to 25% by weight of a second substance, selected from polyethylene glycol and nonionic surfactants which are different from the surfactant of the formula (I), (c) 1 to 5% by weight of silica or silicate, and (d) 40 to 70% by weight of at least one auxiliary selected from alkali metal citrate, alkali metal carbonate or at least one chelating agent selected from compounds of the general formula (II)

$$R^3—CH(COOM^1)-N(CH_2COOM^1)_2 \quad (II)$$

in which the variables are defined as follows:

$R^3$ is selected from $C_1$-$C_4$-alkyl, phenyl, benzyl, $CH_2OH$ and $CH_2CH_2COOM^1$, and
$M^1$ is an alkali metal or a combination of at least two alkali metals, wherein the granule is solid at a temperature of up to 60° C., and wherein a fraction of component (b) in the granule is at least as high as a fraction of component (a).

7. The granule according to claim 6, wherein a particle diameter distribution of the granule is as follows:

$d_m$ is in a range from 0.5 to 1.8 mm,
$d_{63.3}$ is in a range from 0.4 to 1.8 mm and
n is in a range from 0.7 to 10, determined in each case by sieve analysis according to DIN ISO 3310-1 (1992) and evaluation according to DIN 66145 (1976).

8. A rinse aid, comprising the granule according to claim 6.

9. The rinse aid according to claim 8, wherein the rinse aid is a rinse aid for a dishwasher or a component for an x-in-1 dishwashing detergent.

* * * * *